US012455127B2

(12) United States Patent
Jones

(10) Patent No.: US 12,455,127 B2
(45) Date of Patent: Oct. 28, 2025

(54) AMBIDEXTROUS CHARGING HANDLE

(71) Applicant: Dustin Christopher Jones, Marquez, TX (US)

(72) Inventor: Dustin Christopher Jones, Marquez, TX (US)

( * ) Notice: Subject to any disclaimer, the term of this patent is extended or adjusted under 35 U.S.C. 154(b) by 0 days.

(21) Appl. No.: 18/667,523

(22) Filed: May 17, 2024

(65) Prior Publication Data

US 2024/0384956 A1 Nov. 21, 2024

Related U.S. Application Data

(60) Provisional application No. 63/467,460, filed on May 18, 2023.

(51) Int. Cl.
*F41A 3/72* (2006.01)
*F41A 35/06* (2006.01)

(52) U.S. Cl.
CPC ..... *F41A 3/72* (2013.01); *F41A 35/06* (2013.01)

(58) Field of Classification Search
CPC ..... F41A 3/72; F41A 35/06
See application file for complete search history.

(56) References Cited

U.S. PATENT DOCUMENTS 3,225,653 A * 12/1965 Packard ..... F41A 3/72 89/1.4
7,832,322 B1 * 11/2010 Hoel ..... F41A 3/20 89/1.4
8,356,537 B2 * 1/2013 Kincel ..... F41A 3/72 89/1.4
8,960,066 B2 * 2/2015 Gomez ..... F41A 3/72 89/1.4
9,488,424 B1 * 11/2016 Kincel ..... F41A 3/66
10,161,697 B1 * 12/2018 Underwood ..... F41A 3/72
10,451,369 B1 * 10/2019 Hunt ..... F41A 35/06
11,466,945 B2 * 10/2022 Underwood ..... F41A 35/06
2014/0060293 A1 * 3/2014 Gomez ..... F41A 35/06 89/1.4
2016/0356564 A1 * 12/2016 Curry ..... F41A 3/72
2017/0299294 A1 * 10/2017 Underwood ..... F41A 3/72
2020/0292258 A1 * 9/2020 Hubbell ..... F41A 3/72
2021/0080202 A1 * 3/2021 Jung ..... F41A 3/72
2021/0172692 A1 * 6/2021 Frazier ..... F41A 35/06
2021/0180895 A1 * 6/2021 Nolte ..... F41A 3/72
2021/0222972 A1 * 7/2021 Bray ..... F41A 35/06
2021/0381785 A1 * 12/2021 Underwood ..... F41A 3/72
2022/0316831 A1 * 10/2022 Torgersen ..... F41A 35/06
2022/0412680 A1 * 12/2022 Sensinger ..... F41A 3/72
2023/0204310 A1 * 6/2023 Torgersen ..... F16J 15/02 89/1.4

* cited by examiner

*Primary Examiner* — Joshua E Freeman
(74) *Attorney, Agent, or Firm* — Reid Law Practice PLLC; Frank E. Reid

(57) ABSTRACT

Disclosed is a charging handle comprising an ambidextrous latch mechanism having smooth operability produced by a small contact area of moving parts in the latch mechanism and/or preparation of the hinge contact surfaces between moving parts of the latch mechanism. The latch mechanism comprises a first and a second lever disposed on either side of a latch base. The levers are rotatably attached to the latch base. The first and second levers are rotatably engaged at the rearward ends of the levers.

19 Claims, 5 Drawing Sheets

AMBIDEXTROUS CHARGING HANDLE

CROSS-REFERENCE TO RELATED APPLICATIONS

This application claims priority of U.S. Provisional patent application Ser. No. 63/467,460, entitled "AMBIDEXTROUS CHARGING HANDLE," filed on May 18, 2023, the contents of which are incorporated by reference herein in their entirety.

FIELD OF THE INVENTION

This disclosure relates generally to firearms and more particularly to a charging handle associated therewith.

BACKGROUND OF THE INVENTION

The charging handle is an integral part of certain firearms, such as, but not limited to AR-15 and/or AR-15 style rifle. The charging handle serves as a manual mechanism for chambering a round and engaging the bolt carrier mechanism.

The original AR-15/M16 rifles introduced in the 1960s featured a simple, non-ambidextrous charging handle located on the top of the receiver. It had a relatively small latch that required a rearward pull to chamber a round or to lock the bolt carrier group to the rear. In the 1980s, the military adopted the "A2" style of charging handle, which featured a larger latch for improved gripping surface. This design allowed for easier manipulation, particularly when wearing gloves.

As the popularity of the AR-15 platform grew among civilian shooters, demand increased for ambidextrous charging handles that could be easily operated by both right-handed and left-handed shooters. To address this, manufacturers introduced ambidextrous charging handles with enlarged latches on both sides of the handle, allowing for easier and more efficient manipulation from either side of the rifle.

In recent years, charging handle designs have seen further innovation. Manufacturers have introduced features such as extended latches, textured surfaces, and improved ergonomics to enhance grip and ease of operation. These enhancements aim to address some of the common complaints associated with traditional charging handles.

Even with all the enhancements to charging handles over the course of time, some users may still find certain charging handles uncomfortable or difficult to manipulate, particularly if they have larger hands or if the handle lacks sufficient texture or grip. Complaints include a lack of leverage, sharp edges, or a design that does not accommodate different shooting positions.

Some charging handles are reported to be prone to snagging on gear, clothing, or accessories during operation and/or transport of the firearm, movement, which can impede the smooth functioning of the rifle. This can be particularly problematic in close-quarters environments or when using slings.

Customers may complain about charging handles that are prone to breaking or experiencing excessive wear and tear. This could include issues such as latch failure, sheared roll pins, or bending under heavy use. Complaints related to material quality, manufacturing defects, or inadequate reinforcement are common.

Some users may prefer ambidextrous charging handles to accommodate left-handed or weak-hand operation. Complaints can arise if the charging handle lacks ambidextrous features or if the design does not function as smoothly for both right-handed and left-handed shooters.

A charging handle that exhibits excessive play or looseness when in the forward or rearward position may be a cause for complaint. Users might find this movement distracting or may worry about reliability or long-term durability.

Customers may express dissatisfaction with charging handles that generate excessive noise during operation, such as rattling or clanking. While not necessarily impacting functionality, noise-related complaints can affect overall user experience and perceived quality.

Many advances have been made in the design and manufacture of charging handles. However, there is still a need for further development of charging handles having smooth operation, reduced racking force requirements, and simpler assembly with fewer moving parts. Ideally, charging handles with improved operability would be compatible with and/or be suited for retrofitting of commercially available firearms.

SUMMARY OF THE INVENTION

In some embodiments, a charging handle is provided for a firearm having a receiver. The charging handle comprises a shaft having a latch mechanism at a rearward end and a bolt carrier engagement element at a forward end. The latch mechanism comprises a latch base comprising a lower base plate having a top surface and an upper base plate having a bottom surface. The top surface of the lower base plate and the bottom surface of the upper base plate are parallel to each other and to a first plane defined herein for purposes of orienting components of the charging handle with respect to one another. A second plane is defined herein as a plane perpendicular to the first plane and passing through the centerline of the charging handle.

A first lever is rotationally engaged with the latch base about a first axis proximate the rearward portion of the first lever, wherein the first axis is perpendicular to the first plane. A second lever rotationally engaged with the latch base about a second axis proximate the rearward portion of the second lever. The second axis is perpendicular to the first plane and parallel with the first axis. The second plane bisects a first distance between the first axis and the second axis.

A rearward end of the first lever and a rearward end of the second lever are rotationally engaged with one another about a third axis coplanar with the second plane.

The foregoing has outlined rather broadly the features and technical advantages of the present invention in order that the detailed description of the invention that follows may be better understood. Additional features and advantages of the invention will be described hereinafter, which form the subject matter of the claims of the invention. It should be appreciated by those skilled in the art that the conception and specific embodiments disclosed may be readily utilized as a basis for modifying or designing other variations for carrying out the same purposes of the present invention. It should also be realized by those skilled in the art that such equivalent constructions do not depart from the spirit and scope of the invention as set forth in the appended claims. The novel features which are believed to be characteristic of the invention, together with further objects and advantages, will be better understood from the following description.

BRIEF DESCRIPTION OF THE FIGURES

The claimed subject matter may be understood by reference to the following description taken in conjunction with the accompanying drawings, in which like reference numerals identify like elements, and in which:

Figure 1:
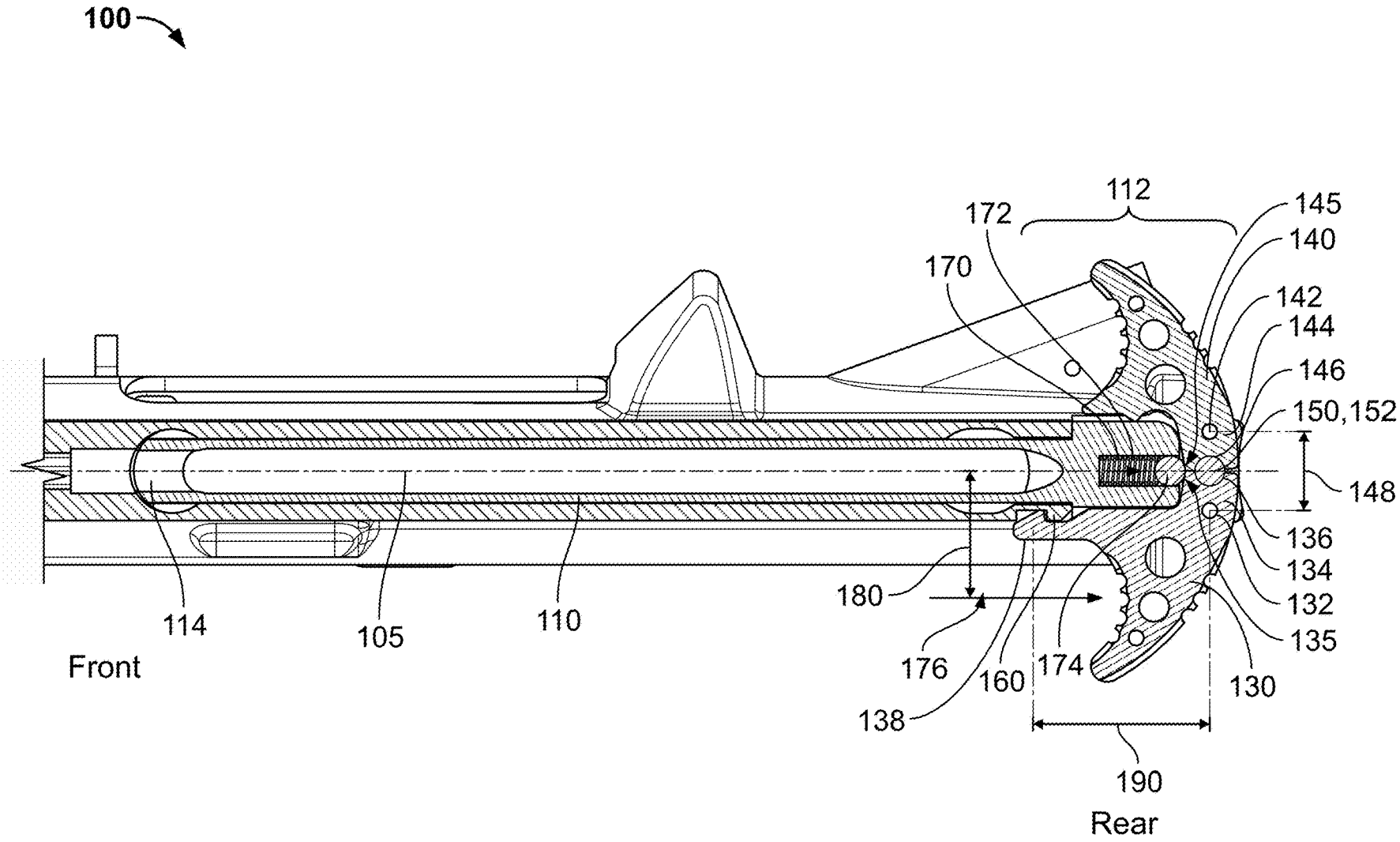
FIG. 1 shows a top-down view of a horizontal cross-section of a charging handle according to an embodiment of the invention.

While the disclosed apparatus and components are susceptible to various modifications and alternative forms, the drawings illustrate specific embodiments herein described in detail by way of example. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

The present invention relates to firearms and, more particularly, to a ambidextrously operated charging handle for the manual manipulation of a firearms bolt carrier group, for military and/or personal semi-automatic firearms, including but not limited to the Stoner-type family of firearm systems such as the AR-10, AR-15, M16, and M4 series firearms; all AR-10 type, AR-15 type, M16 type, M4 type firearms; and all clones and derivatives of the foregoing. The charging handle is used to manually manipulate the bolt carrier group of a firearm. With such firearms, the charging handle is used to chamber an initial round of ammunition, to clear malfunctions, and as a means to retract the bolt carrier group for inspection of the firearms interior.

In practice the charging handle is mounted within the upper receiver, engaging with a forward portion of the bolt carrier group, with the length of the handle running parallel with the bolt carrier group. In this orientation the handle portion of charging handle is manually operated to pull the bolt carrier group to the rear and load the first round of ammunition. Once the firearm is discharged the gas pressure produced by the discharged round of ammunition is sufficient to load subsequent rounds of ammunition.

Illustrative embodiments of the subject matter claimed below will now be disclosed. In the interest of clarity, some features of some actual implementations may not be described in this specification. It will be appreciated that in the development of any such actual embodiments, numerous implementation-specific decisions must be made to achieve the developer's specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than the broadest meaning understood by skilled artisans, such a special or clarifying definition will be expressly set forth in the specification in a definitional manner that provides the special or clarifying definition for the term or phrase.

Illustrative embodiments of the subject matter claimed below will now be disclosed. In the interest of clarity, some features of some actual implementations may not be described in this specification. It will be appreciated that in the development of any such actual embodiments, numerous implementation-specific decisions must be made to achieve the developer's specific goals, such as compliance with system-related and business-related constraints, which will vary from one implementation to another. Moreover, it will be appreciated that such a development effort, even if complex and time-consuming, would be a routine undertaking for those of ordinary skill in the art having the benefit of this disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than the broadest meaning understood by skilled artisans, such a special or clarifying definition will be expressly set forth in the specification in a definitional manner that provides the special or clarifying definition for the term or phrase. It must also be noted that, as used in the specification and the appended claims, the singular forms "a," "an," and "the" include plural references unless otherwise specified.

For example, the following discussion contains a non-exhaustive list of definitions of several specific terms used in this disclosure (other terms may be defined or clarified in a definitional manner elsewhere herein). These definitions are intended to clarify the meanings of the terms used herein. It is believed that the terms are used in a manner consistent with their ordinary meaning, but the definitions are nonetheless specified here for clarity.

Definitions

As used herein, "comprising" is to be interpreted as specifying the presence of the stated features, integers, steps, or components as referred to, but does not preclude the presence or addition of one or more features, integers, steps, or components, or groups thereof. Moreover, each of the terms "by", "comprising," "comprises", "comprised of" "including," "includes," "included," "involving,"

"involves," "involved," and "such as" are used in their open, non-limiting sense and may be used interchangeably. Further, the term "comprising" is intended to include examples and aspects encompassed by the terms "consisting essentially of" and "consisting of." Similarly, the term "consisting essentially of" is intended to include examples encompassed by the term "consisting of."

As used herein, "consisting essentially of" excludes additional material elements, but allows the inclusions of non-material elements that do not substantially change the nature of the invention.

As used herein, "consisting of" is closed and excludes all additional elements.

As used herein, "first plane", "second plane", "first axis", "second axis," and "third axis" provide for a theoretical frame of reference for a firearm in a normal level firing position with respect to the ground.

As used herein, "front", "rear", "right", and "left" and similar terms in the context of the firearm provide for a theoretical frame of reference wherein an operator of the firearm holds the weapon at the rear and fired ammunition leaves the barrel of the weapon at the front.

As used herein, "slip tight fit" means a fitment of components that is tighter than a typical slip fit but not as tight as a press fit. While the parts can be slipped together, they fit snugly but slidably once assembled. A slip fit, also known as a clearance fit, allows the parts to assemble easily without the need for tools. The shaft in a slip fit has a smaller diameter than the hole, providing a clearance that permits free movement without any interference. A press fit, also known as an interference fit, requires force for assembly. The shaft is slightly larger than the hole, creating interference that holds the parts firmly together without the need for additional fasteners.

As used herein, "substantially equal" in some embodiments means a difference of less than or equal to 10%, less than or equal to 5%, or less than or equal to 1%.

Charging Handle

Aspects of this disclosure provide for a charging handle comprising an ambidextrous latch mechanism having smooth operability produced by a small contact area of moving parts in the latch mechanism and/or preparation of the hinge contact surfaces between moving parts of the latch mechanism. The latch mechanism comprises a first and a second lever disposed on either side of a latch base. The levers are rotatably attached to the latch base. The first and second levers are rotatably engaged at the rearward ends of the levers.

In some embodiments, a charging handle for a firearm having a receiver comprises a shaft having a latch mechanism at a rearward end and a bolt carrier engagement element at a forward end. The latch mechanism comprises a latch base, a first lever, and a second lever. The latch base comprises a lower base plate having a top surface and an upper base plate having a bottom surface. The top surface and the bottom surface are parallel to a first plane and perpendicular to a second plane, wherein the second plane passes through the centerline of the charging handle.

The first lever is rotationally engaged with the latch base about a first axis proximate the rearward portion of the first lever. The first axis is perpendicular to the first plane. The second lever rotationally engaged with the latch base about a second axis proximate the rearward portion of the second lever. The second axis is perpendicular to the first plane and parallel to the first axis.

The second plane bisects a first distance between the first axis and the second axis, and a rearward end of the first lever and a rearward end of the second lever are rotationally engaged about a third axis coplanar with the second plane. The third axis is also parallel with the first axis and the second axis and perpendicular to the first plane. When the first lever moves in a clockwise direction, the second lever moves in a counterclockwise direction and vice versa. Concurrent with such rotational motion of the first and second levers, the third axis moves forward or backward with respect to the first and second axes longitudinally along the centerline of the charging handle while remaining within the second plane.

In some embodiments, rotational engagement of the rearward end of the first lever and rearward end of the second lever comprises a first ball bearing disposed between the rearward end of the first lever and rearward end of the second lever. In further embodiments, the top surface of the lower base plate comprises a first semicircular groove proximate to the second plane, the bottom surface of the upper base plate comprises a second semicircular groove proximate to the second plane, and the first ball bearing engages the first semicircular groove and the second semicircular groove.

In some embodiments, the latch mechanism is operable between a first position and a second position. At least one of the first lever and the second lever further comprises a first hook element or a second hook element, respectively, at its forward end. The first hook element and/or the second hook element are suitable for engaging to the firearm receiver when the latch mechanism is in the first or closed position. The first hook element and/or the second hook element are suitable for disengaging from the firearm receiver when the latch mechanism is in the second or open position. In some embodiments, an angular displacement of the first lever about the first axis and the second lever about the second axis between the first position and the second position is sufficient to disengage the first hook element and/or the second axis from the receiver when the latch mechanism in the second position. In some embodiments, an angular displacement of the first lever about the first axis and the second lever about the second axis between the first position and the second position is in the range of from 4°, 5°, or 6° to 8°, 9°, or 10°, wherein 0° is the first or closed position.

In some embodiments, first axis and the first hook element and/or the second axis and the second hook element are separated by a third distance, wherein the third distance is sufficient to disengage the first hook element and/or the second axis from the receiver when the latch mechanism in the second position. In some embodiments, the ratio of the third distance to the first distance is greater than or equal to 1.5, greater than or equal to 1.6, greater than or equal to 1.7, greater than or equal to 1.8, greater than or equal to 1.9, or greater than or equal to 2.0. In some embodiments, the ratio of third distance to the first distance is less than or equal to 3.0, less than or equal to 2.9, less than or equal to 2.8, less than or equal to 2.7, less than or equal to 2.6, or less than or equal to 2.5.

In some embodiments, the latch mechanism further comprises a biasing element suitable for providing a biasing force to urge the latch mechanism to the first position. In some embodiments, the biasing element comprises a spring secured in a manner suitable for application of the biasing force in a rearward direction proximate the rearward end of the first lever and the rearward end of the second lever. In some embodiments, the latch mechanism further comprises a second ball bearing between the spring and the engagement of the rearward end of the first lever and the rearward end of the second lever. In some embodiments, the rearward portion of the first lever engages the second ball bearing at a first contact point, the rearward portion of the second lever engages the second ball bearing at a second contact point, and operation of the latch mechanism from the first position toward the second position causes compression of the spring and increases the distance between the first contact point and the second contact point. In further embodiments, application of a racking force in the rearward direction to at least one of the first lever or the second lever overcomes the biasing force to urge the latch mechanism to the second position.

In some embodiments, the racking force is applied at a second distance from the second plane, wherein the second distance is greater than or equal to the first distance. In some embodiments, the ratio of the second distance to the first distance is greater than or equal to 1.05, greater than or equal to 1.10, greater than or equal to 1.15, greater than or equal to 1.20, or greater than or equal to 1.25. In some embodiments, the ratio of the second distance to the first distance is less than or equal to 1.5, less than or equal to 1.55, less than or equal to 1.60, less than or equal to 1.65, less than or equal to 1.70, or less than or equal to 1.75.

In some embodiments, the latch mechanism further comprises a dust cover. In some embodiments, a gap is formed between a rearward edge of the first lever and a rearward edge of the second lever, and the dust cover is configured to cover the gap in a manner suitable to limit or prevent entry of dust and/or debris from penetrating the interior of the latch mechanism.

Performance Attributes

A charging handle as disclosed herein offers one or more advantages over currently available charging handles.

In some embodiments, the latch assembly comprises a first lever and a second lever, wherein the first lever does not depend on the second lever for operation nor assembly. Either the first or the second lever can be removed, and the remaining components would remain functional and functional. This is with the proviso that the remaining lever comprises a hook to secure the charging handle to the receiver. The first lever can be removed, and all the components will be retained in place and functional.

In some embodiments, the latch assembly comprises a second bearing, wherein the second bearing reduces friction and allows a cam effect functioning to aid in racking the charging handle.

In some other available charging handles, the distance analogous to the first distance herein is greater than or equal to 1 inch. In some embodiments, the first distance is less than or equal to 15/16 inch, less than or equal to 7/8 inch, less than or equal to 13/16 inch, less than or equal to 3/4 inch, less than or equal to 11/16 inch, or less than or equal to 5/8 inch. The shorter first distance allows the use of smaller stock for the charging handle. In some embodiments, the first distance is greater than or equal to 1/2 inch, greater than or equal to 15/32 inch, greater than or equal to 7/16 inch, greater than or equal to 13/32 inch, or greater than or equal to 3/8 inch.

In some embodiments, the levers do not require additional rotational machining axis for fabrication. This also reduces the complexity of the fixturing required to work and/or hold components during the machining process.

In some embodiments, the levers comprise internal cylindrical profiles, which provide holding points for holding and/or indexing lever pieces during the machining process.

In some embodiments, the symmetrical design of the levers and/or latch mechanism allows the use of fewer profiles and in some cases fewer components for function;

In some embodiments, the first ball bearing reduces any drag for functioning from the first position to the second position, further enhanced by smooth finish of the hinge contact surfaces.

In some embodiments, the third distance provides for less angular travel required to operate the latch mechanism from the first position to the second position, while many alternatives require more rotation thus allowing the operators finger to unintentionally to come off of the lever during cycling.

In some embodiments, the large outside radius features of the levers reduces the effect of the levers digging into user while the firearm is in a slung position (i.e., no sharp corners on lever tips).

In some embodiments, deep finger grooves in the levers allow secure finger placement during the functioning cycle.

In some embodiments, the first ball bearing fits the first and second levers in such a way to float them in between the slot on the stem, further reducing any drag—i.e., the contact point of both levers are not directly to the body of the stem, but instead the contact points are the levers to the pins, levers to the first and second ball and first lever hook to the receiver, thus not rubbing and no need for a washer between components. The contact points at the third axis are between the first lever and the first ball bearing and between the second lever and the first ball bearing. The tolerances of the dowel pins at the first axis and the second axis that the concave spherical surfaces at the contact points of the first and second levers with the first ball bearing serve to keep the upper and lower surfaces of the first and second levers both parallel to and spaced apart from the lower surface of the upper base plate and the upper surface of the lower base plate. The contact points for application of the biasing force are between the first lever and the second ball bearing and between the second lever and the second ball bearing. These connections all provide for both reduced contact area between components of the latch mechanism and less friction between surfaces of components that are in contact with one another.

In some embodiments, the configuration of the "hinge" formed at the third axis, enabled by the first ball bearing, permits the first distance to be smaller than possible in other configurations. The geometry provided by the specified ratios of the first, second, and third distances all provide for a lower profile and a shorter throw (i.e., rearward displacement of first/second levers required to transition from engaged with the receiver to disengaged).

Materials of Construction

In some embodiments, aluminum is used as a material of construction for components other than bearings as it can provide a useful balance of strength, resilience, hardness, and cost. The 6000 series and 7000 series are two important categories of aluminum alloys widely used in various industries, including aerospace, automotive, and construction. These aluminum grades differ in terms of composition and mechanical properties.

6000 series aluminum alloys are primarily alloyed with magnesium and silicon. Common alloys include 6061 and 6063. The addition of magnesium and silicon forms magnesium silicide within the alloy, which allows it to be heat treatable. 7000 series aluminum alloys are primarily alloyed with zinc along with magnesium and sometimes copper to enhance its strength. A typical example is 7075 aluminum, which is one of the strongest aluminum alloys available.

6000 series aluminum alloys have moderate hardness but are more formable and more workable than the 7000 series aluminum alloys. They can be tempered to increase their hardness, with 6061-T6 being a common hard temper. 7000 series aluminum alloys are harder than those in the 6000 series. This increased hardness comes at the cost of decreased workability and increased brittleness, especially in complex forms.

6000 series aluminum alloys provide good strength and are considered moderate compared to 7000 series alloys. They are suitable for applications where some structural strength is necessary but not critical, such as architectural frameworks and automotive parts. 7000 series aluminum alloys are known for higher strength, surpassing that of many steels. 7075 aluminum, for example, has strength comparable to many steels and is used in applications such as aerospace components, where high strength is crucial.

Although components other than bearings of the latching mechanism can be fabricated from any aluminum, prototype testing indicates that improved reliability and longevity can be achieved with 7000 series aluminum alloys. Good results were achieved using 7075 aluminum.

In some embodiments, a metal selected for a material of construction for components other than bearings has a yield strength as measured by ASTM B557 of greater than or equal to 40 kpsi, greater than or equal to 45 kpsi, greater than or equal to 50 kpsi, greater than or equal to 55 kpsi, greater than or equal to 60 kpsi, or greater than or equal to 65 kpsi.

In some embodiments, a metal selected for a material of construction for components other than bearings has a tensile strength as measured by ASTM B557 of greater than or equal to 50 kpsi, greater than or equal to 55 kpsi, greater than or equal to 60 kpsi, greater than or equal to 65 kpsi, greater than or equal to 70 kpsi, or greater than or equal to 75 kpsi.

In some embodiments, material of construction for components other than bearings is treated to Type III hardcoat anodized hardness reference from Mil-spec. In some embodiments, anodizing is performed to Mil-A-8625 Type III Hardcoat, wherein Rockwell C hardness (RC) is greater than or equal to 50 RC, greater than or equal to 55 RC, or in the range of 60 RC to 70 RC.

In some embodiments, material of construction for bearings include but are not limited to AISI 52100 steel, stainless steel, ceramic materials, case-hardened steels, and high nitrogen stainless steel. AISI 52100 steel is a high-carbon chromium steel that provides excellent hardness and wear resistance due to its carbon and chromium content, typically showing a hardness of around 60-66 RC. It also has good fatigue resistance and maintains its strength under repeated stress. Stainless steels useful as ball bearings herein include but are not limited to AISI 316, AISI 440C, AISI 420. Nitronic 50 (XM-19), and Cronidur 30. Ceramic materials, such as but not limited to silicon nitride are sometimes used in ball bearings for applications where corrosion, high temperatures, or extremely harsh conditions exceed the capabilities of steel. Ceramic bearings are lighter, have lower friction, and can operate without lubrication in extreme conditions. Case-hardened steels, such as but not limited to AISI 8620 and AISI 4320 steels are not as commonly used as AISI 52100 but are chosen for applications where shock resistance is critical. They are less brittle and more ductile, absorbing impacts better due to their tough core. High nitrogen stainless steel, such as but not limited to grades like Cronidur 30 (available from ThyssenKrupp Steel) comprise a high nitrogen, high chromium martensitic steel, offer excellent fatigue life, high tensile strength, and corrosion resistance. They are used in high-performance aerospace and precision applications. Success has been achieved in prototype latching mechanisms with AISI 316.

In some embodiments, a material selected for construction of bearings has a hardness as measured by Rockwell C in the range of from 20 RC to 45 RC, from 21 RC to 44 RC, from 22 RC to 43 RC, from 23 RC to 42 RC, from 24 RC to 41 RC, or from 25 RC to 40 RC.

In some embodiments, a material selected for construction of bearings has a surface roughness (Ra) in the range of from 0.60 to 1.20, from 0.65 to 1.15, from 0.70 to 1.10, from 0.75 to 1.05, or from 0.80 to 1.00, as measured according to ASME B46.1.

In some embodiments, all components of the latching mechanism are free of lubrication in order to reduce the buildup of debris in the mechanism.

In some embodiments, a spring providing biasing force comprises a stainless steel and has a rate in the range of from 26.0 lb/in. to 30 lb/in., from 26.5 lb/in. to 29.5 lb/in., from 27.0 lb/in. to 29.0 lb/in., or from 27.5 lb/in. to 28.5 lb/in.

DISCUSSION OF DRAWINGS

FIG. 1-FIG. 6 show different views of an embodiment of a charging handle as disclosed herein, wherein the last two digits of the reference numbers indicate common components and/or aspects of the embodiment. Only a portion of the labeled elements and/or aspects of the embodiment are shown in each figure as some figures show only a portion of the charging handle. Further, each figure omits references to some elements or aspects of the embodiment, since such elements or aspects are obscured or omitted by the particular view of the embodiment of the charging handle.

FIG. 1 shows an overhead view of a horizontal cross-section of an embodiment of the charging handle 100 disclosed herein. The charging handle 100 comprises a shaft 110 having a latch mechanism 112 at a rearward end and a bolt carrier engagement element 114 at a forward end. The latch mechanism 112 comprises a latch base comprising a lower base plate (obscured) having a top surface and an upper base plate (omitted in this cross-section view. The top surface of the lower base plate is parallel to a first plane and perpendicular to a second plane, which passes through the centerline 105 of the charging handle 100.

A first lever 130 is rotationally engaged with the latch base about a first axis 132 proximate the rearward portion 134 of the first lever 130. The first axis is perpendicular to the first plane, or for purposes of FIG. 1, perpendicular to the sheet containing the 2-dimensional horizontal cross-section of charging handle 100. A second lever 140 is rotationally engaged with the latch base about a second axis 142 proximate the rearward portion 144 of the second lever 140. The second axis is perpendicular to the first plane, or for purposes of FIG. 1, perpendicular to the sheet containing the 2-dimensional horizontal cross-section of charging handle 100 and is also parallel to the first axis 132. The second plane bisects a first distance 148 between the first axis 132 and the second axis 142.

A rearward end 134 of the first lever 130 and a rearward end 144 of the second lever 140 are rotationally engaged about a third axis 150. The third axis 150 is coplanar with the second plane. That is to say, that the third axis 150 or hinge point between the rearward end 134 of the first lever 130 and a rearward end 144 of the second lever 140 lies along the centerline 105 of the charging handle 100. The rotational engagement of or hinge point between the rearward end 134 of the first lever 130 and rearward end 144 of the second lever 140 contact with a first ball bearing 152. The hinge contact surface 136 of the rearward end 134 of the first lever 130 and the hinge contact surface 146 of the rearward end 144 of the second lever 140 are spherically concave at a radius substantially the same as the first ball bearing 152 and suitable for contacting opposite sides of the first ball bearing 152. After assembly of the latch mechanism 112, the hinge point formed by the lever ends 134, 144 and the first ball bearing 152 interact to both allow smooth rotation of the hinge point around the third axis 150 maintain the first ball bearing 152 in position between the two lever ends 134, 144.

The latch mechanism 112 is operable between a first position and a second position. FIG. 1 shows the first or engaged position. In the embodiment shown in FIG. 1, the first lever 130 further comprises a hook element 138 at its forward end. The hook element 138 engages to the firearm receiver 160 when the latch mechanism 112 is in the first position. Rotation of the first and second levers 130, 140 about their respective axes 132, 142 moves the levers 130, 140 to a second or disengaged position, wherein the hook element 138 is disengaged from the firearm receiver 160, thereby allowing rearward motion of the charging handle 100 with respect to the receiver 160. In some embodiments, operation of the latch mechanism 112 between the first position and the second position is accomplished through an angular displacement in the range of from 4°, 5°, or 6° to 8°, 9°, or 10°.

The latch mechanism 112 further comprises a biasing element suitable for providing a biasing force 172 to urge the latch mechanism 112 to the first or engaged position. In the embodiment of FIG. 1, the biasing element comprises a spring 170 and a second ball bearing 174 secured in a cavity at the rearward end of the shaft 110 of the charging handle 100. Biasing force 170 is transmitted to first and second levers 130, 140 by contact between second ball bearing 174 and bias contact surfaces 135, 145, respectively.

The latch mechanism 112 is moved to the second or disengaged position by applying a racking force in the rearward direction to either or both of the levers 130, 140. FIG. 1 shows application of the racking force 176 to the first lever 130. To which lever the racking force 176 is applied makes no difference as rotational engagement of the hinge point between the rearward ends of the levers 130, 140 forces the first lever 130 and second lever 140 to rotate synchronously in opposite directions as the rotational engagement or hinge point between the rearward ends 134, 144 of the levers 130, 140 moves forwardly to compress the spring 170, thus overcoming the biasing force.

The shape of the levers 130, 140 facilitates application of the racking force 176 at a second distance 180 from the second plane, wherein the second distance 180 is greater than or equal to the first distance 148. The first axis 132 and the hook element 138 are separated by a third distance 190, wherein the third distance 190 is sufficient to disengage the hook element 138 from the firearm receiver 160 when the latch mechanism 112 is in the second position. In some embodiments, the third distance 190 is greater than or equal to twice the first distance 148.

In some embodiments, after assembly of other components of the latch mechanism 112: a) the hinge contact surfaces 136, 146 and the first ball bearing 152 have a fitment equivalent to a slip tight fit; b) the outer surface of the threaded dowel pins and the inner surface of the holes in the first and second levers (i.e., the first axis and the second axis, respectively) have a fitment equivalent to a slip tight fit; or c) a combination thereof.

Figure 2:
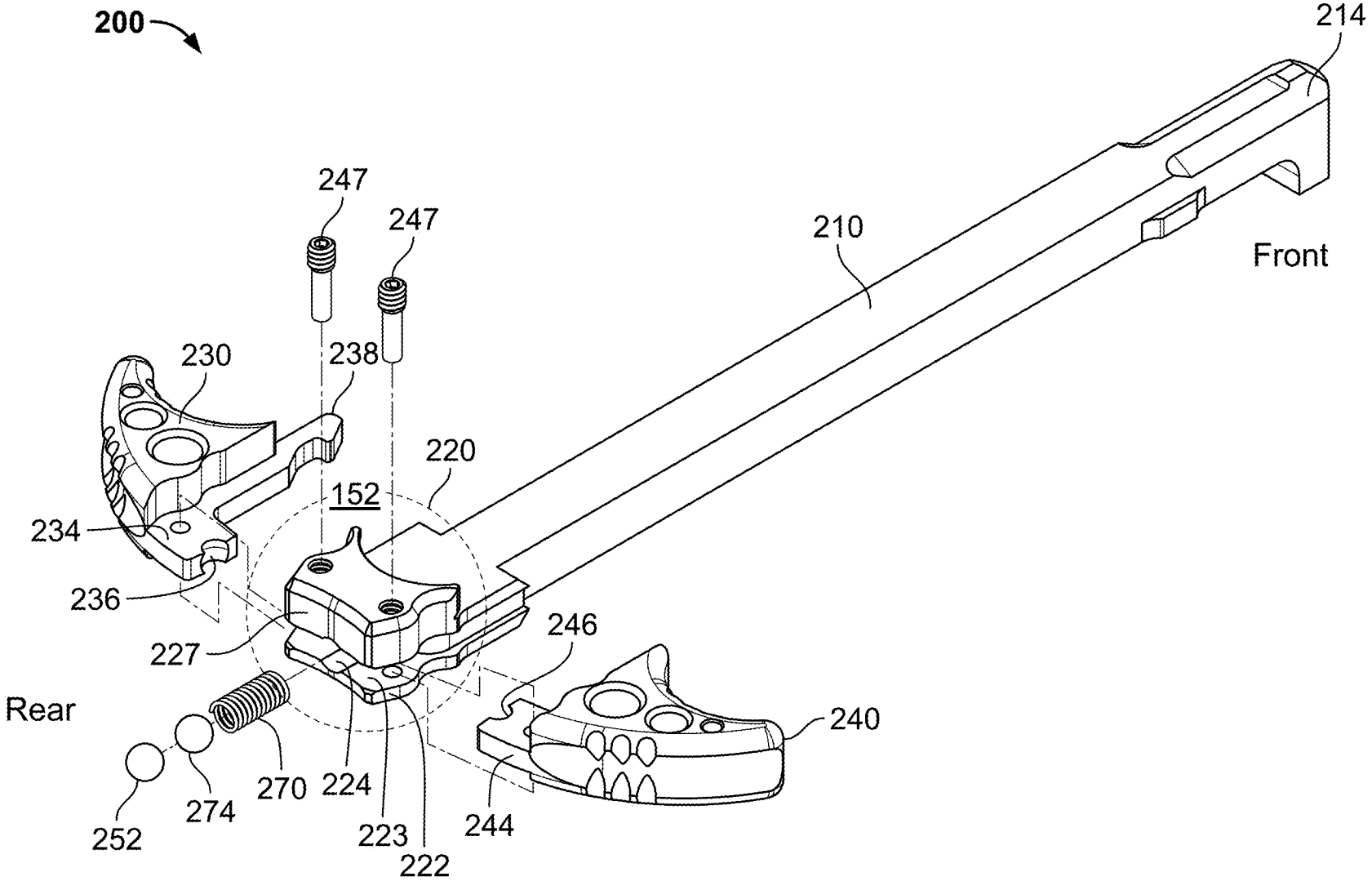
FIG. 2 shows an expanded perspective view of the components of a charging handle according to an embodiment of the invention.

FIG. 2 shows an expanded view of a charging handle 200 in order to better show individual components of the embodiment of the charging handle 200. The charging handle 200 comprises a shaft 210 having a latch mechanism at a rearward end and a bolt carrier engagement element 214 at a forward end. The latch mechanism comprises a latch base 220 comprising a lower base plate 222 having a top surface 223 comprising a semicircular groove 224 and an upper base plate 227. The top surface 223 of the lower base plate 222 is parallel to a first plane and perpendicular to a second plane, which passes through the centerline of the charging handle 200.

The shaft 210 comprises a cavity at its rearward end for installation of a spring 270 and a second ball bearing 274.

The semicircular groove 224 is suited to engage the first ball bearing 252. The first and second levers 230, 240 have holes proximate to their respective rearward portions 234, 244, respectively. The first ball bearing 252 is disposed between the upper base plate 227 and the lower base plate 222. Motion of the first ball bearing 252 is limited to forward and backward motion by engagement with the semicircular groove (obscured) in the bottom surface (obscured) of the upper base plate 227 and a corresponding groove 224 in the top surface 223 of the lower base plate 222.

The latch mechanism is assembled by aligning the holes in the upper base plate 227 and lower base plate 222, and the corresponding holes in the first and second levers 230, 240 to permit installation of threaded dowel pins 247. After installed, threaded dowel pins 247 attach the first and second levers 230, 240 to the latch base 220 in a manner permitting the first and second levers 230, 240 to rotate about the first and second axes, respectively. The spherically concave hinge contact surfaces 236, 246 at the rearward ends 234, 244 of the first and second levers 230, 240 engage the first ball bearing 252 to maintain a clearance between the levers 230, 240 and the upper and lower base plates 222, 227. The rearward ends 234, 244 of the first and second levers 230, 240 also engage with the second ball bearing 274 to facilitate a biasing force from spring 270 to urge the latch mechanism to the closed or engaged position, wherein hook element 238 would be engaged with the receiver.

Figure 3A:
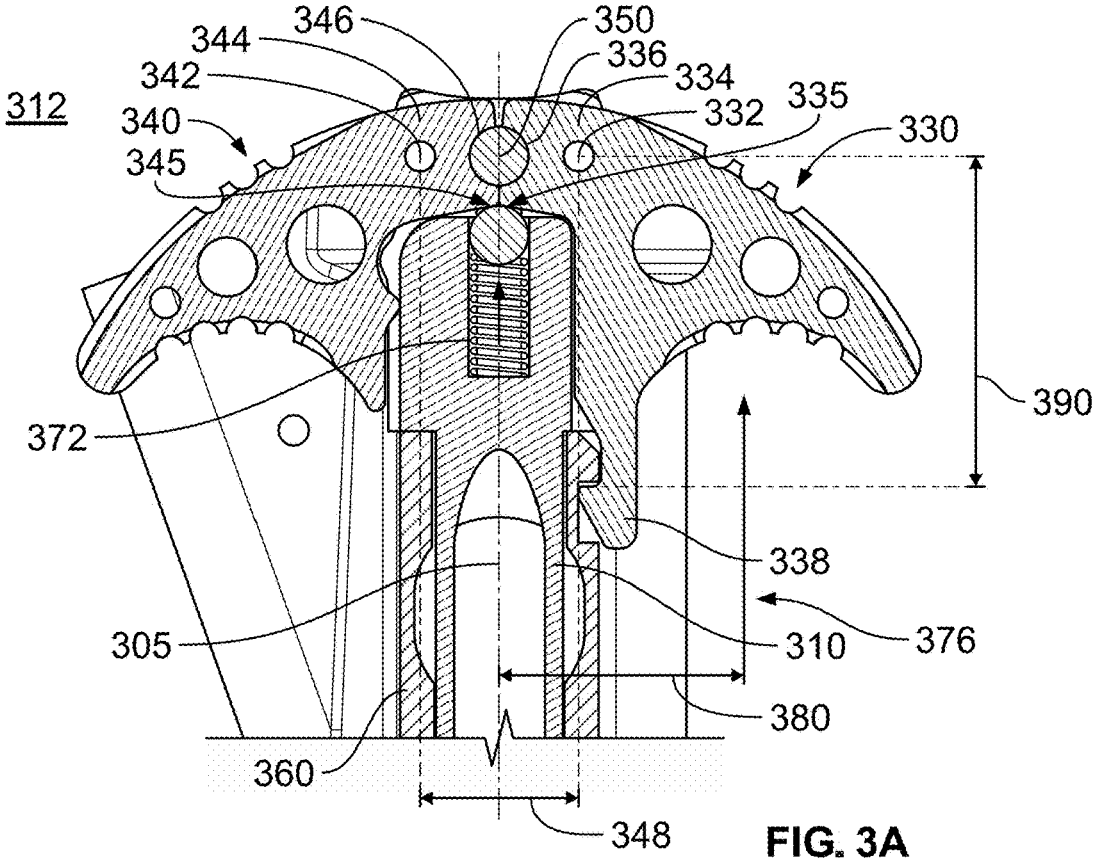
FIG. 3A and FIG. 3B show a top-down view of a horizontal cross-section of the latch mechanism of a charging handle according to an embodiment of the invention, wherein the latch mechanism is in the closed or engaged position in FIG. 3A and in the open or disengaged position in FIG. 3B.
Figure 3B:
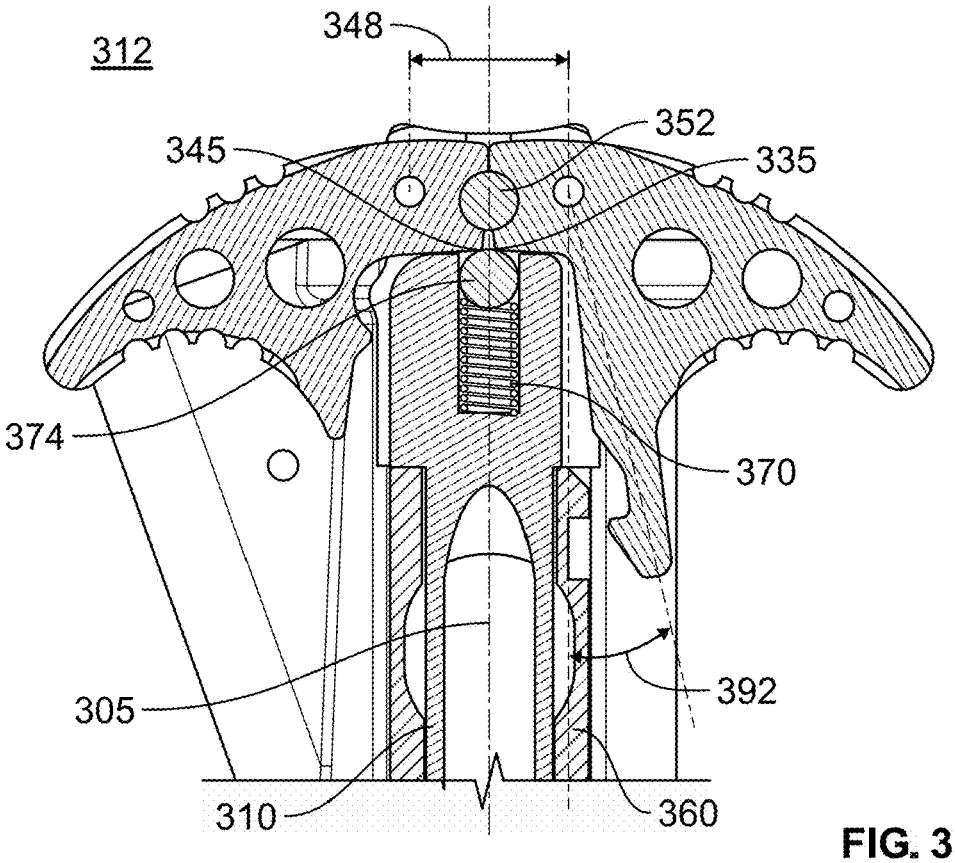

FIG. 3A and FIG. 3B are the same top-down view of a horizontal cross-section of the latch mechanism 312 at the rear end of shaft 310, with the exception that FIG. 3A shows the latch mechanism 312 in the closed or engaged position while FIG. 3B shows the latch mechanism 312 in the open or disengaged position. The first and second levers 330, 340 are rotatably engaged about the third axis 350 by hinge contact surfaces 336, 346 being maintained in contact with the first ball bearing 352.

Rotation of first and second levers 330, 340 about the first and second axes 332, 342 and relative to the latch base is maintained by threaded dowel pins installed through holes proximate to the rearward portions 334, 344 of the levers 330, 340 and corresponding holes in the latch base. First and second axes 332, 342 are separated by first distance 348 and are on opposite sides of and equidistant from centerline 305. The shape of the levers 330, 340 facilitates application of the racking force 376 at a second distance 380 from the second plane, wherein the second distance 380 is greater than or equal to the first distance 348.

A biasing force 372 produced by compression of spring 370 is delivered to bias contact points 335, 345 of the levers 330, 340, respectively, through the second ball bearing 374. In the closed or engaged position, hook element 338 is engaged with the firearm receiver 360, as shown in FIG. 3A. In the open or disengaged position, hook element 338 is disengaged with the firearm receiver 360, as shown in FIG. 3B, thus permitting axial motion of the charging handle with respect to the firearm receiver 360. FIG. 3B shows the angle 392 that the first lever 330 (and the second lever 340) travels between the open position and the closed position of the latch mechanism 312. The levers 330, 340 are moved from the closed or engaged position to the open or disengaged position by application of racking force 376 to at least one of the levers 330, 340. The first axis 332 and the hook element 338 are separated by a third distance 390, wherein the third distance 390 is sufficient to disengage the hook element 338 from the firearm receiver 360 when the latch mechanism 312 is in the second position. In some embodiments, the third distance 390 is greater than or equal to twice the first distance 348.

Figure 4A:
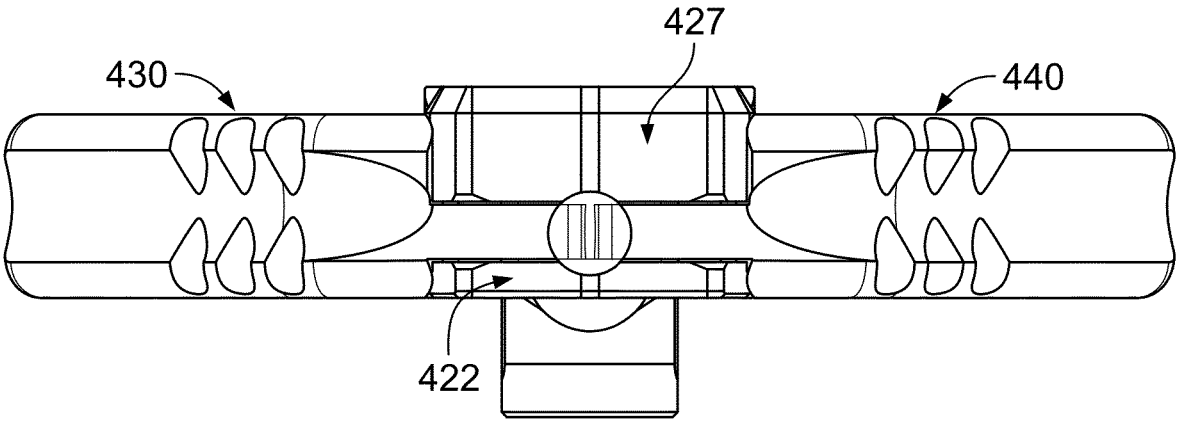
FIG. 4A and FIG. 4B show a rear elevation view (FIG. 4A full end view and FIG. 4B magnified view of center portion) of the latch mechanism of a charging handle according to an embodiment of the invention.
Figure 4B:
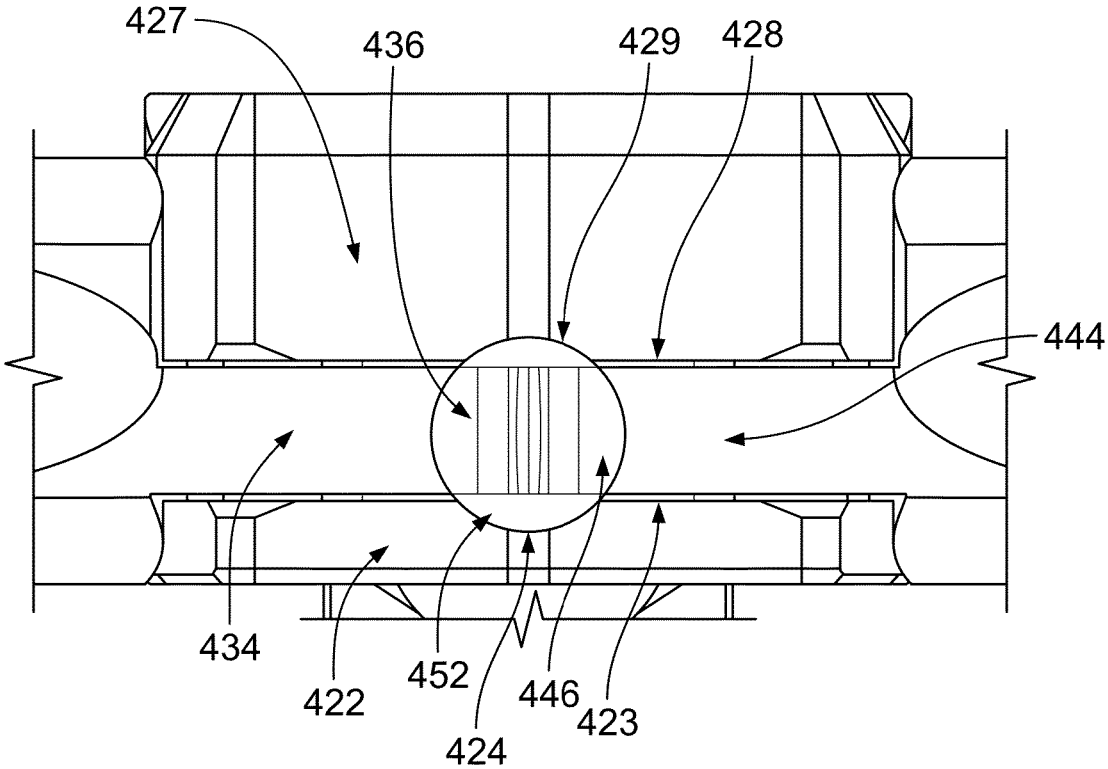

FIG. 4A shows a rear elevation view of a latch mechanism 412. FIG. 4B shows a magnified view of the center portion of FIG. 4A. The first ball bearing 452 is disposed between lower base plate 422 and upper base plate 427. The first ball bearing 452 is restricted to move only forward and backward on a path parallel to the centerline of the charging handle by containment within a semicircular groove 424 in the top surface 423 of the lower base plate 422 and a semicircular groove 429 in the bottom surface 428 of the upper base plate 427.

The first ball bearing 452 is also in contact with the concave spherical surface 436 at the rearward portion 434 of the first lever and the concave spherical surface 446 at the rearward portion 444 of the second lever. This shows that the grooves in the upper and lower base plates and the concave surfaces at the rearward ends of the levers interface with the first ball bearing to maintain a clearance between the levers and the latch base.

Figure 5:
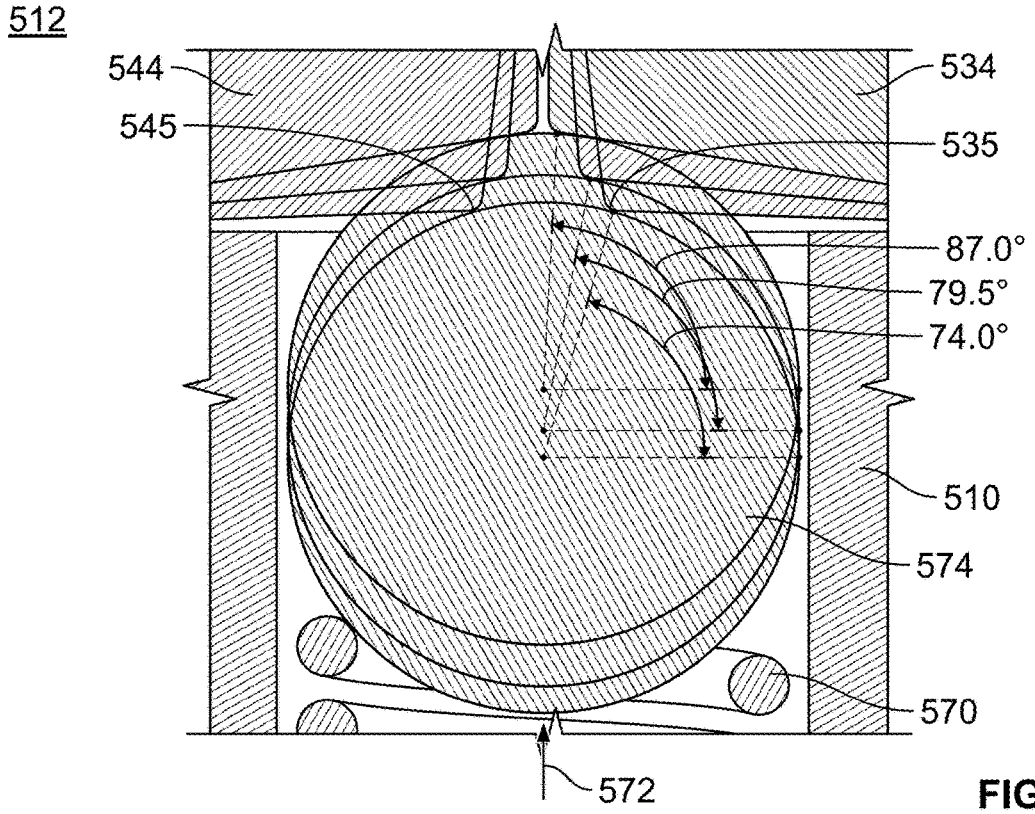
FIG. 5 shows a top-down view of a horizontal cross-section of the latch mechanism of a charging handle depicting movement of the parts of the biasing element of a charging handle according to an embodiment of the invention.

FIG. 5 shows a top-down view of a horizontal cross section of a portion of the latch mechanism 512. FIG. 5 shows three "snapshots" of the motion of the biasing element as the racking force is applied to move the latch mechanism 512 from the closed or engaged position as shown in FIG. 3A to the open or disengaged position as shown in FIG. 3B.

The closed or engaged position of the latch mechanism 512 is indicated by uppermost position of the second ball bearing 574 in FIG. 5. In this position, the contact points 535, 545 of the rearward portions 534, 544 of the levers are spaced apart by a first distance, and the spring 570 is at a first extension.

An intermediate position of the latch mechanism 512 is indicated by middle position of the second ball bearing 574 in FIG. 5. In this position, the contact points 535, 545 of the rearward portions 534, 544 of the levers are spaced apart by a second distance, greater than the first distance, and the spring 570 is at a second extension, less than the first extension. Spring 570 maintains biasing force 572 on second ball bearing 574.

The open or disengaged position of the latch mechanism 512 is indicated by the lowermost position of the second ball bearing 574 in FIG. 5. In this position, the contact points 535, 545 of the rearward portions 534, 544 of the levers are spaced apart by a third distance, greater than the second distance, and the spring 570 is at a third extension, less than a second extension.

Lateral motion of the second ball bearing is restricted by the walls of the cavity at the rearward end of the shaft 510. As the contact points 535, 545 move farther apart, the increasing angle of contact with the spherical surface of the second ball bearing 574 results in an increasing component of force transverse to the second plane that aids in moving the latch mechanism to the open or disengaged position, partially offsetting the additional biasing force produced by compression of the spring 570.

Figure 6:
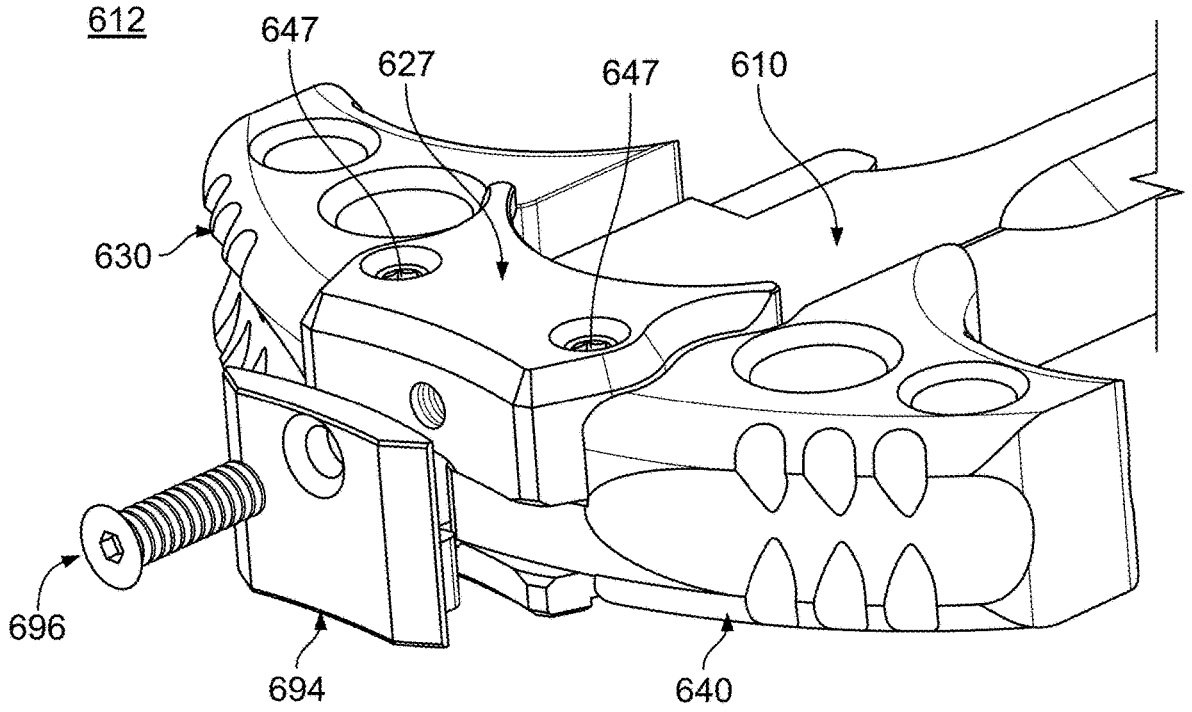
FIG. 6 shows an expanded perspective view of installation of a dust cover (DUST COVER) on the rearmost end of the latch mechanism according to an embodiment of the invention.

FIG. 6 shows an embodiment of a latch mechanism 612 having a lower profile, wherein the profile is indicated by the width for the latching mechanism from the outer tip of lever 630 to the outer time of lever 640. Military and/or law enforcement personnel may wear equipment that make a lower profile firearm desirable or even critical. Such equipment can include but not be limited to tactical vests and plate carriers, backpacks and rucksacks, utility belts, loose clothing, communications equipment, body armor, holsters, hydration systems, slings, helmet accessories, or combination thereof. Alone or in combination such equipment can present snag points due to straps, hoses, wires, Velcro™ fasteners, and the like and general discontinuities due to a combination of equipment. A lower profile latch mechanism leading to a lower profile firearm reduces the chance of firearm hanging up or getting caught in such equipment, potentially leading to damage to such equipment and/or a delay in the operator being able to deploy the firearm from the stowed position to a ready or firing position.

In some embodiments, irrespective of profile, latch mechanism 612 further comprises a dust cover 694 as shown in FIG. 6. The dust cover 694 can be a flat or curved member suitable for engaging with the rearward surface of upper base plate 627 while covering the rearward gap between first and second levers 630, 640. Dust cover 694 is configured to cover the gap in a manner suitable to limit or prevent entry of dust and/or debris from penetrating the interior of the latch mechanism. Dust cover 694 is particularly useful when the firearm will be exposed to dusty, wet, or muddy conditions.

Dust cover 694 is shown to be connected to the rearward surface of upper base plate 627 using mounting fastener 696. Mounting fastener 696 is shown as a separate threaded connector. However, the mounting fastener 696 can be integral with the dust cover 694, such as, but not limited to, an outwardly flaring tongue on the mounting fastener 696 to engage with an inwardly flaring groove on the rearward surface of upper base plate 627 or an outwardly flaring tongue on the rearward surface of upper base plate 627 to engage with an inwardly flaring groove on or mounting fastener 696. In some embodiments, such tongue and groove is vertical or substantially vertical with respect to the firearm.

Another feature of the latch mechanism 612 is the thickness or height of upper base plate 627 with respect to the remainder of shaft 610. The upper surface of upper base plate 627 is above the upper surface of the remainder of shaft 610 to provide for the use of threaded dowel pins 647. It was unexpectedly discovered that the front surface of base plate 627 (i.e., the transition between the upper surface of base plate 627 and the upper surface of the remainder of shaft 610) provides for deflection of high pressure gases generated when the firearm is fired away from the operator of the firearm. In some embodiments, the front surface of base plate 627 is vertical or substantially vertical.

Certain Embodiments

A charging handle for a firearm having a receiver is disclosed herein. The charging handle comprises a shaft having a latch mechanism at a rearward end and a bolt carrier engagement element at a forward end. In some embodiments, the latch mechanism comprises a latch base comprising a lower base plate having a top surface and an upper base plate having a bottom surface. The top surface of the lower base plate and the bottom surface of the upper base plate are parallel to a first plane and perpendicular to a second plane. The second plane also passes through the centerline of the charging handle.

First and second levers are rotationally engaged to opposite sides of the latch base. A first lever is rotationally engaged with the latch base about a first axis, wherein the first axis is proximate to the rearward portion of the first lever. The first axis perpendicular to the first plane. A second lever is rotationally engaged with the latch base about a second axis, wherein the second axis is proximate to the rearward portion of the second lever. The second axis is perpendicular to the first plane and parallel to the first axis. The second plane bisects a first distance between the first axis and the second axis.

A rearward end of the first lever and a rearward end of the second lever are rotationally engaged about a third axis coplanar with the second plane.

In some embodiments, in addition to the limitations of any one of the foregoing embodiments, the charging handle is further characterized by one of more of the following:

a) rotational engagement of the rearward end of the first lever and rearward end of the second lever comprises a first ball bearing disposed between the rearward end of the first lever and rearward end of the second lever, wherein, in further embodiments, the top surface of the lower base plate comprises a first semicircular groove proximate to the second plane, the bottom surface of the upper base plate comprises a second semicircular groove proximate to the second plane, and the first ball bearing engages the first semicircular groove and the second semicircular groove; and b) the latch mechanism is operable between a first position and a second position, and at least one of the first lever and the second lever further comprises a first hook element or a second hook element, respectively, at its forward end, the first hook element and/or the second hook element suitable for engaging to the firearm receiver when the latch mechanism is in the first position and disengaging from the firearm receiver when the latch mechanism is in the second position.

In some embodiments, for embodiments where a first and second position has been defined, the charging handle is further characterized by one of more of the following:

a) an angular displacement of the first lever about the first axis and the second lever about the second axis between the first position and the second position is in the range of from 4°, 5°, or 6° to 8°, 9°, or 10°;

b) first axis and the first hook element and/or the second axis and the second hook element are separated by a third distance, wherein the third distance is greater than or equal to twice the first distance;

c) the first axis and the first hook element and/or the second axis and the second hook element are separated by a third distance, wherein the third distance is sufficient to disengage the first hook element and/or the second axis from the receiver when the latch mechanism in the second position; and d) the latch mechanism further comprises a biasing element suitable for providing a biasing force to urge the latch mechanism to the first position.

In some embodiments, for any of the foregoing embodiments comprising a biasing force, the latch mechanism further comprises a spring secured the latch mechanism in a manner suitable for application of the biasing force in a rearward direction proximate the rearward end of the first lever and the rearward end of the second lever. In some embodiments, the latch mechanism further comprises a second ball bearing between the spring and the engagement of the rearward end of the first lever and the rearward end of the second lever. In yet further embodiments, the rearward portion of the first lever engages the second ball bearing at a first contact point, the rearward portion of the second lever engages the second ball bearing at a second contact point, and operation of the latch mechanism from the first position toward the second position causes compression of the spring and increases the distance between the first contact point and the second contact point.

In some embodiments, for any of the foregoing embodiments comprising a biasing force, the latch mechanism, application of a racking force in the rearward direction to at least one of the first lever or the second lever overcomes the biasing force to urge the latch mechanism to the second position. In yet further embodiments, the racking force is applied at a second distance from the second plane, wherein:

a) the second distance is greater than or equal to the first distance; and/or b) the ratio of the second distance to the first distance is greater than or equal to 1.05, greater than or equal to 1.10, greater than or equal to 1.15, greater than or equal to 1.20, or greater than or equal to 1.25. In some embodiments, the ratio of the second distance to the first distance is less than or equal to 1.75, less than or equal to 1.70, less than or equal to 1.65, less than or equal to 1.60, less than or equal to 1.55, or less than or equal to 1.5.

In some embodiments, in addition to the limitations of any one of the foregoing embodiments, the charging handle further comprises a dust cover. In some embodiments, a gap is formed between a rearward edge of the first lever and a rearward edge of the second lever, and the dust cover is configured to cover the gap in a manner suitable to limit or prevent entry of dust and/or debris from penetrating the interior of the latch mechanism.

For the sake of brevity, only certain ranges are explicitly disclosed herein. However, in addition to recited ranges, any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, within a range includes every point or individual value between its end points even though not explicitly recited. Thus, every point or individual value may serve as its own lower or upper limit combined with any other point or individual value or any other lower or upper limit, to recite a range not explicitly recited.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the machines, means, apparatuses, devices, and/or components described in the specification. As one of the ordinary skill in the art will readily appreciate from the disclosure of the present invention, machines, means, apparatuses, devices, and/or components, presently existing or later to be developed that perform substantially the same function or achieve substantially the same result as the corresponding embodiments described herein, may be utilized according to the present invention. Accordingly, the appended claims are intended to include within their scope such machines, means, apparatuses, devices, and/or components.

What is claimed is:

1. A charging handle for a firearm having a receiver, the charging handle comprising a shaft having a latch mechanism at a rearward end and a bolt carrier engagement element at a forward end, wherein the latch mechanism comprises:

a latch base comprising a lower base plate having a top surface and an upper base plate having a bottom surface, wherein the top surface and the bottom surface are parallel to a first plane and perpendicular to a second plane, which passes through the centerline of the charging handle;

a first lever rotationally engaged with the latch base about a first axis proximate the rearward portion of the first lever, the first axis perpendicular to the first plane; and a second lever rotationally engaged with the latch base about a second axis proximate the rearward portion of the second lever, the second axis perpendicular to the first plane;

wherein:

the second plane bisects a first distance between the first axis and the second axis;

a rearward end of the first lever and a rearward end of the second lever are rotationally engaged about a third axis coplanar with the second plane; and the rotational engagement of the rearward end of the first lever and rearward end of the second lever comprises a first ball bearing disposed between the rearward end of the first lever and rearward end of the second lever.

2. The charging handle of claim 1, wherein:

the top surface of the lower base plate comprises a first semicircular groove;

the bottom surface of the upper base plate comprises a second semicircular groove; and the first ball bearing engages the first semicircular groove and the second semicircular groove.

3. The charging handle of claim 1, wherein:

the latch mechanism is operable between a first position and a second position; and at least one of the first lever and the second lever further comprises a first hook element or a second hook element, respectively, at its forward end, the first hook element and/or the second hook element suitable for engaging to the firearm receiver when the latch mechanism is in the first position and disengaging from the firearm receiver when the latch mechanism is in the second position.

4. The charging handle of claim 3, wherein an angular displacement of the first lever about the first axis and the second lever about the second axis between the first position and the second position is in the range of from 4° to 10°.

5. The charging handle of claim 3, wherein the first axis and the first hook element and/or the second axis and the second hook element are separated by a third distance, wherein the third distance is greater than or equal to twice the first distance.

6. The charging handle of claim 5, wherein in the ratio of the third distance to the first distance is in a range of from 1.5 to 3.0.

7. The charging handle of claim 3, wherein the first axis and the first hook element and/or the second axis and the second hook element are separated by a third distance, wherein the third distance is sufficient to disengage the first hook element and/or the second axis from the receiver when the latch mechanism is in the second position.

8. The charging handle of claim 3, wherein the latch mechanism further comprises a biasing element suitable for providing a biasing force to urge the latch mechanism to the first position.

9. The charging handle of claim 8, wherein the biasing element comprises a spring secured in a manner suitable for application of the biasing force in a rearward direction proximate the rearward end of the first lever and the rearward end of the second lever.

10. The charging handle of claim 9, wherein the latch mechanism further comprises a second ball bearing between the spring and the engagement of the rearward end of the first lever and the rearward end of the second lever.

11. The charging handle of claim 10, wherein:

the rearward portion of the first lever engages the second ball bearing at a first contact point;

the rearward portion of the second lever engages the second ball bearing at a second contact point; and operation of the latch mechanism from the first position toward the second position causes compression of the spring and increases the distance between the first contact point and the second contact point.

12. The charging handle of claim 9, wherein application of a racking force in the rearward direction to at least one of the first lever or the second lever overcomes the biasing force to urge the latch mechanism to the second position.

13. The charging handle of claim 12, wherein the racking force is applied at a second distance from the second plane, wherein the second distance is greater than or equal to the first distance.

14. The charging handle of claim 13, wherein the ratio of the second distance to the first distance is in a range of from 1.05 to 1.75.

15. The charging handle of claim 12, wherein the latch mechanism further comprises a dust cover.

16. The charging handle of claim 15, wherein:

a gap is formed between a rearward edge of the first lever and a rearward edge of the second lever; and the dust cover is configured to cover the gap in a manner suitable to limit or prevent entry of dust and/or debris from penetrating the interior of the latch mechanism.

17. A charging handle for a firearm having a receiver, the charging handle comprising a shaft having a latch mechanism at a rearward end and a bolt carrier engagement element at a forward end, wherein the latch mechanism comprises:

a latch base comprising a lower base plate having a top surface and an upper base plate having a bottom surface, wherein the top surface and the bottom surface are parallel to a first plane and perpendicular to a second plane, which passes through the centerline of the charging handle;

a first lever rotationally engaged with the latch base about a first axis proximate the rearward portion of the first lever, the first axis perpendicular to the first plane; and a second lever rotationally engaged with the latch base about a second axis proximate the rearward portion of the second lever, the second axis perpendicular to the first plane;

wherein:

the second plane bisects a first distance between the first axis and the second axis;

a rearward end of the first lever and a rearward end of the second lever are rotationally engaged about a third axis coplanar with the second plane;

the latch mechanism is operable between a first position and a second position;

at least one of the first lever and the second lever further comprises a first hook element or a second hook element, respectively, at its forward end, the first hook element and/or the second hook element suitable for engaging to the firearm receiver when the latch mechanism is in the first position and disengaging from the firearm receiver when the latch mechanism is in the second position;

the latch mechanism further comprises a biasing element suitable for providing a biasing force to urge the latch mechanism to the first position;

the biasing element comprises a spring secured in a manner suitable for application of the biasing force in a rearward direction proximate the rearward end of the first lever and the rearward end of the second lever; and the latch mechanism further comprises a second ball bearing between the spring and the engagement of the rearward end of the first lever and the rearward end of the second lever.

18. The charging handle of claim 17, wherein:

the rearward portion of the first lever engages the second ball bearing at a first contact point;

the rearward portion of the second lever engages the second ball bearing at a second contact point; and operation of the latch mechanism from the first position toward the second position causes compression of the spring and increases the distance between the first contact point and the second contact point.

19. A charging handle for a firearm having a receiver, the charging handle comprising a shaft having a latch mechanism at a rearward end and a bolt carrier engagement element at a forward end, wherein the latch mechanism comprises:

a latch base comprising a lower base plate having a top surface and an upper base plate having a bottom surface, wherein the top surface and the bottom surface are parallel to a first plane and perpendicular to a second plane, which passes through the centerline of the charging handle;

a first lever rotationally engaged with the latch base about a first axis proximate the rearward portion of the first lever, the first axis perpendicular to the first plane; and a second lever rotationally engaged with the latch base about a second axis proximate the rearward portion of the second lever, the second axis perpendicular to the first plane;

wherein:

the second plane bisects a first distance between the first axis and the second axis;

a rearward end of the first lever and a rearward end of the second lever are rotationally engaged about a third axis coplanar with the second plane;

the latch mechanism is operable between a first position and a second position;

at least one of the first lever and the second lever further comprises a first hook element or a second hook element, respectively, at its forward end, the first hook element and/or the second hook element suitable for engaging to the firearm receiver when the latch mechanism is in the first position and disengaging from the firearm receiver when the latch mechanism is in the second position;

the latch mechanism further comprises a biasing element suitable for providing a biasing force to urge the latch mechanism to the first position;

the biasing element comprises a spring secured in a manner suitable for application of the biasing force in a rearward direction proximate the rearward end of the first lever and the rearward end of the second lever;

application of a racking force in the rearward direction to at least one of the first lever or the second lever overcomes the biasing force to urge the latch mechanism to the second position;

the latch mechanism further comprises a dust cover;

a gap is formed between a rearward edge of the first lever and a rearward edge of the second lever; and the dust cover is configured to cover the gap in a manner suitable to limit or prevent entry of dust and/or debris from penetrating the interior of the latch mechanism.

* * * * *